US010349685B2

(12) United States Patent
Romero et al.

(10) Patent No.: US 10,349,685 B2
(45) Date of Patent: Jul. 16, 2019

(54) CLOTHING ARTICLES ESPECIALLY USEFUL FOR AQUATIC ACTIVITIES

(71) Applicant: BOARDRIDERS IP HOLDINGS, LLC, Huntington Beach, CA (US)

(72) Inventors: Aaron M. Romero, El Cajon, CA (US); Brad Lancaster, Laguna Beach, CA (US); Dustin Pettit, Laguna Beach, CA (US)

(73) Assignee: BOARDRIDERS IP HOLDINGS, LLC, Huntington Beach, CA (US)

( * ) Notice: Subject to any disclaimer, the term of this patent is extended or adjusted under 35 U.S.C. 154(b) by 81 days.

(21) Appl. No.: 15/307,118

(22) PCT Filed: May 18, 2016

(86) PCT No.: PCT/US2016/032974

§ 371 (c)(1),
(2) Date: Oct. 27, 2016

(87) PCT Pub. No.: WO2016/196009

PCT Pub. Date: Dec. 8, 2016

(65) Prior Publication Data

US 2017/0172225 A1 Jun. 22, 2017

Related U.S. Application Data

(60) Provisional application No. 62/169,797, filed on Jun. 2, 2015.

(51) Int. Cl.
*A41D 7/00* (2006.01)
*A41D 31/00* (2019.01)
(Continued)

(52) U.S. Cl.
CPC ..... *A41D 7/005* (2013.01); *A41D 27/245* (2013.01); *A41D 31/0005* (2013.01); *A41D 2500/20* (2013.01); *A41D 2600/10* (2013.01)

(58) Field of Classification Search
CPC ..... A41D 13/0015; A41D 1/08; A41D 1/06; A41D 13/0525; A41D 2400/38;
(Continued)

(56) References Cited

U.S. PATENT DOCUMENTS 4,653,122 A * 3/1987 Zanoni ..... A41H 42/00 112/155
5,896,582 A * 4/1999 Baacke ..... A41D 1/08 2/227
(Continued)

FOREIGN PATENT DOCUMENTS

KR 10-2008-0099548 11/2008
WO WO 2014/016643 1/2014

OTHER PUBLICATIONS

International Search Report for PCT/US2016/0132974 and Written Opinion of the ISA dated Aug. 16, 2016, 18 pages.
(Continued)

*Primary Examiner* — Robert H Muromoto, Jr.
(74) *Attorney, Agent, or Firm* — Nixon & Vanderhye P.C.

(57) ABSTRACT

Clothing articles, e.g., aquatic "board" shorts, are generally comprised of at least one unitary woven fabric panel having multiple seamlessly adjacent different fabric weave sections. These seamlessly adjacent different fabric weave sections may be selected from plain fabric weaves, twill fabric weaves and/or Dobby fabric weaves. Aquatic activity shorts are provided which include a one piece rear fabric panel providing a seamless back rise.

8 Claims, 7 Drawing Sheets

(51) Int. Cl.
*A41D 27/24* (2006.01)
*A41D 1/06* (2006.01)

(58) Field of Classification Search
CPC ..... A41D 27/02; A41D 31/02; A41D 7/005; A41D 1/088; A41D 31/00; A41D 13/0537; A41B 2400/38; A41B 2400/32; A41B 9/001; A41B 9/08; A41C 1/08; A41C 1/02; A41C 1/003; A41F 9/02; A41F 9/025; A41F 9/00; A61H 1/008; D03D 13/00; D03D 13/004; D03D 13/008; D03D 15/00
See application file for complete search history.

(56) References Cited

U.S. PATENT DOCUMENTS 9,456,640 B2 * 10/2016 Kemma ..... A41D 1/084
9,993,034 B2 * 6/2018 Callahan ..... A41C 1/08
10,060,054 B2 * 8/2018 Weening ..... D03D 13/00
2003/0208829 A1 * 11/2003 Ragot ..... A41D 7/005 2/67
2012/0233752 A1 * 9/2012 Kemma ..... A41D 1/084 2/465
2012/0246793 A1 * 10/2012 Moore ..... A41D 1/08 2/67
2014/0148741 A1 * 5/2014 Moran ..... A41D 13/0015 601/84
2014/0273743 A1 * 9/2014 Hays ..... A41C 1/08 450/95
2014/0366585 A1 * 12/2014 Shen ..... A41D 13/0015 66/175
2015/0133017 A1 5/2015 Liao et al.
2015/0149115 A1 * 5/2015 Belt ..... A41D 13/065 702/166
2015/0189921 A1 * 7/2015 Callahan ..... A41C 1/08 450/95
2016/0258086 A1 * 9/2016 Turner ..... D04B 1/243
2018/0020746 A1 * 1/2018 Wyner ..... A41D 1/088

OTHER PUBLICATIONS

[Online] "Types of Fabric Weaves" (TE Online), Oct. 13, 2008 [article], http://www.teonline.com/articles/2008/10/types-of-fabric-weaves.html.
EP Application No. 16803977.4, Communication (Extended European Search Report), dated Nov. 2, 2018.

* cited by examiner

CLOTHING ARTICLES ESPECIALLY USEFUL FOR AQUATIC ACTIVITIES

CROSS-REFERENCE TO RELATED APPLICATION

This application is the U.S. national phase of International Application No. PCT/US2016/032974 filed on May 18, 2016 which designated the U.S. and claims priority benefits from U.S. Provisional Application Ser. No. 62/169,797 filed on Jun. 2, 2015, the entire contents of each of which are hereby incorporated by reference.

FIELD

The present invention is related generally to clothing articles that may be employed usefully in aquatic activities, e.g., water sport shorts, swimming attire and the like. In preferred forms, the clothing articles are provided with unitary woven fabric panels with multiple seamlessly adjacent different fabric weave sections.

BACKGROUND AND SUMMARY

Various aquatic sports activities (e.g., surfing, water boarding, water skiing, scuba diving and the like) require clothing articles that are lightweight when saturated with water and exhibit flexibility to enable the individual participant full freedom of movement. Aquatic shorts (colloquially known as "board shorts") that are breathable (fast drying), possess extreme light weight and supportive yet highly flexible are especially desired by water sports enthusiasts. It is towards providing such clothing, especially water shorts, that the embodiments disclosed herein are directed.

The embodiments of the present invention as described herein including clothing articles (e.g., aquatic "board" shorts) are generally comprised of at least one unitary woven fabric panel having multiple differing seamlessly adjacent fabric weave sections. These seamlessly adjacent different fabric weave sections may be selected from plain fabric weaves, twill fabric weaves and/or Dobby fabric weaves.

At least one unitary woven fabric panel of the clothing article may comprise a twill weave section and a Dobby weave section seamlessly joined to one another along a respective interface boundary therebetween. Alternatively or additionally, the at least one unitary woven fabric panel may comprise a plain weave section and a twill weave section seamlessly joined to one another along a respective interface boundary therebetween. According to some embodiments, the at least one unitary woven fabric panel may comprise an upper plain weave section, a lower Dobby weave section and an intermediate twill weave section seamlessly joined to the upper plain and lower Dobby weave sections along respective interface boundaries therebetween.

Some embodiments of the invention are directed toward aquatic activity shorts comprised of a one piece rear fabric panel providing a seamless back rise. Preferably, the one piece rear fabric panel comprises seamlessly adjacent different woven fabric sections that may be selected from plain fabric weaves, twill fabric weaves and/or Dobby fabric weaves.

Certain other embodiments of the aquatic activity shorts may comprise one piece left and right front woven fabric panels, each of which may be comprised of seamlessly adjacent different woven fabric sections. By way of example, the seamlessly adjacent different woven fabric sections of the left and right front woven front fabric panels may be selected from plain fabric weaves, twill fabric weaves and/or Dobby fabric weaves.

If present, the one-piece left and right front woven fabric panels may joined to the one-piece rear fabric panel along a seam that has opposed ends located generally above a knee region of a user at a lower edge of the shorts and extends upwardly and rearwardly around a buttocks region of the user with an apex centrally located adjacent a rear waist region of the user.

According to some embodiments, the left and right front woven fabric panels include seamlessly adjacent left and right rear waist sections. Each of the left and right rear waist sections may comprise upper and lower seamlessly adjacent woven fabric sections.

Some embodiments of the aquatic activity shorts according to the invention may comprise left and right front woven fabric panels and a rear woven fabric panel, wherein each of the left, right and rear fabric panels is formed of a one piece woven fabric having seamlessly adjacent different woven fabric sections. The one piece rear fabric panel may therefore provide a seamless back rise.

The rear woven fabric panel of some embodiments may comprise an upper twill weave section and a lower Dobby weave section seamlessly joined to one another along a respective interface boundary therebetween. The rear woven fabric panel may further comprise lateral arcuate woven fabric sections seamlessly joined to the upper twill and lower Dobby weave sections along respective arcuate interface boundaries therebetween.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

DETAILED DESCRIPTION

A. Definitions

As used herein and in the accompanying claims, the terms below are intended to have the following definitions:

"Filament" means a fibrous strand of extreme or indefinite length.

"Fiber" means a fibrous strand of definite or short length, such as a staple fiber.

"Yarn" means a collection of numerous filaments or fibers which may or may not be textured, spun, twisted or laid together.

"Spinning" means the formation of a yarn by a combination of drafting and twisting or prepared strands of staple fibers, such as rovings.

"Woven fabric" means a fabric composed of two sets of yarns, warp and filling, and formed by interlacing (weaving) two or more warp yarns and filling yarns in a particular weave pattern (e.g., plain weave, twill weave, satin weave Dobby weave and the like). Thus, during weaving the warp and fill yarns will be interlaced so as to cross each other at right angles to produce the woven fabric having the desired weave pattern.

"Plain weave" means a woven fabric wherein weft yarns alternately cross over and under immediately adjacent warp yarns with an adjacent weft yarn alternately passing under and over such immediately adjacent warp yarns, respectively.

"Twill weave" means a woven fabric with a pattern of diagonal parallel ribs formed by the repeated passing of weft yarns over one or more warp yarns and then under two or more warp yarns.

"Dobby weave" means a woven fabric having repeated geometric patterns and texture.

An "elastic filament" or "elastic yarn" means a filament/yarn that can be stretched to a length of at least about 1.5 times, typically at least about 2.0 times, and greater, of its unstretched length and has at least about 90% elastic recovery, typically at least about 92% elastic recovery, up to 100% elastic recovery after one hour relaxation following stretching.

An "inelastic filament" or "inelastic yarn" means a filament/yarn that is not capable of being stretched beyond its maximum tensioned length without some permanent deformation.

B. Exemplary Embodiments

Figure 1:
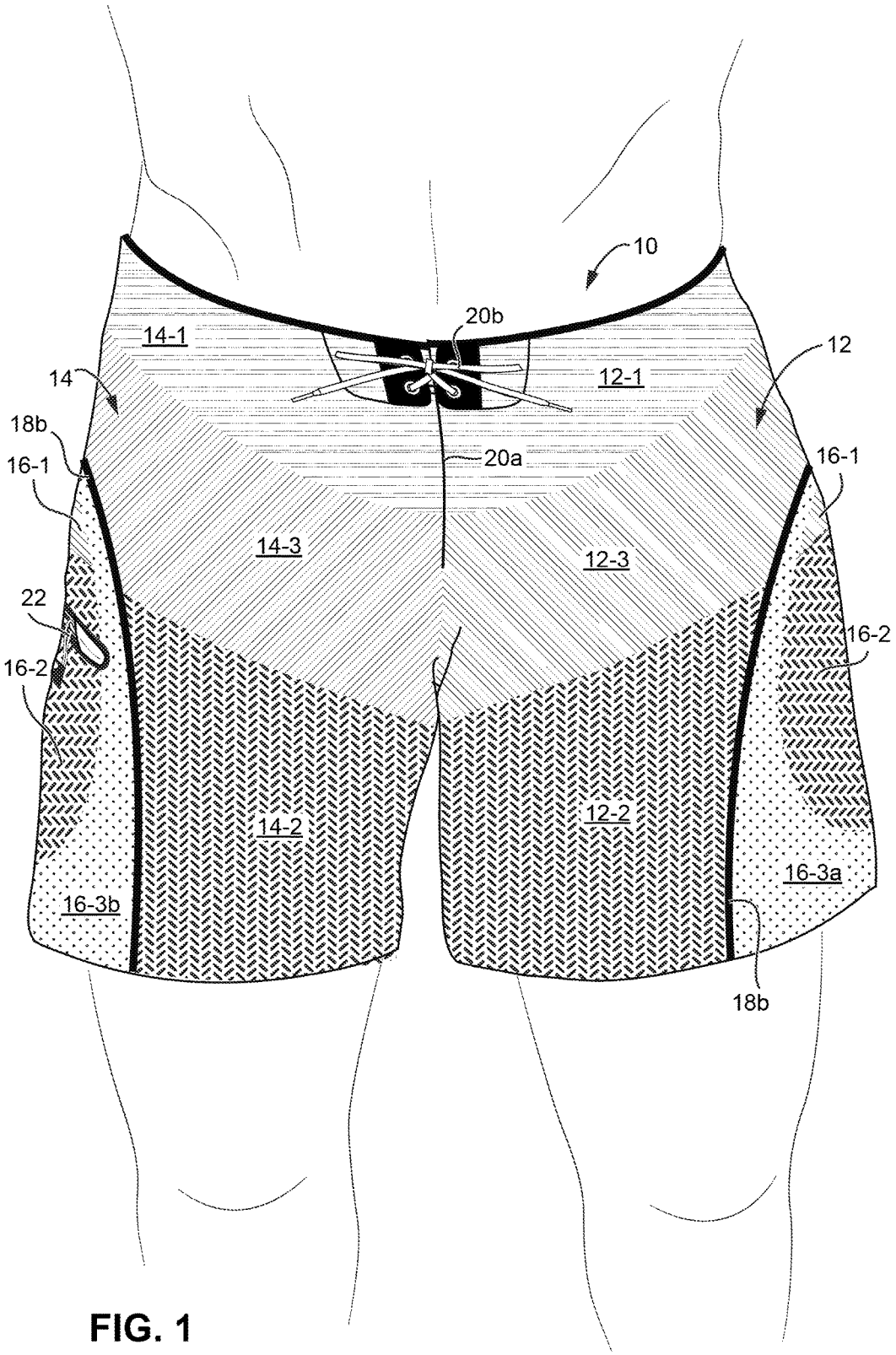
FIG. 1 is a front elevational view of water sports clothing in the form of water shorts in accordance with an embodiment of the present invention shown as being worn to cover a person's pelvic and upper thigh regions.
Figure 2:
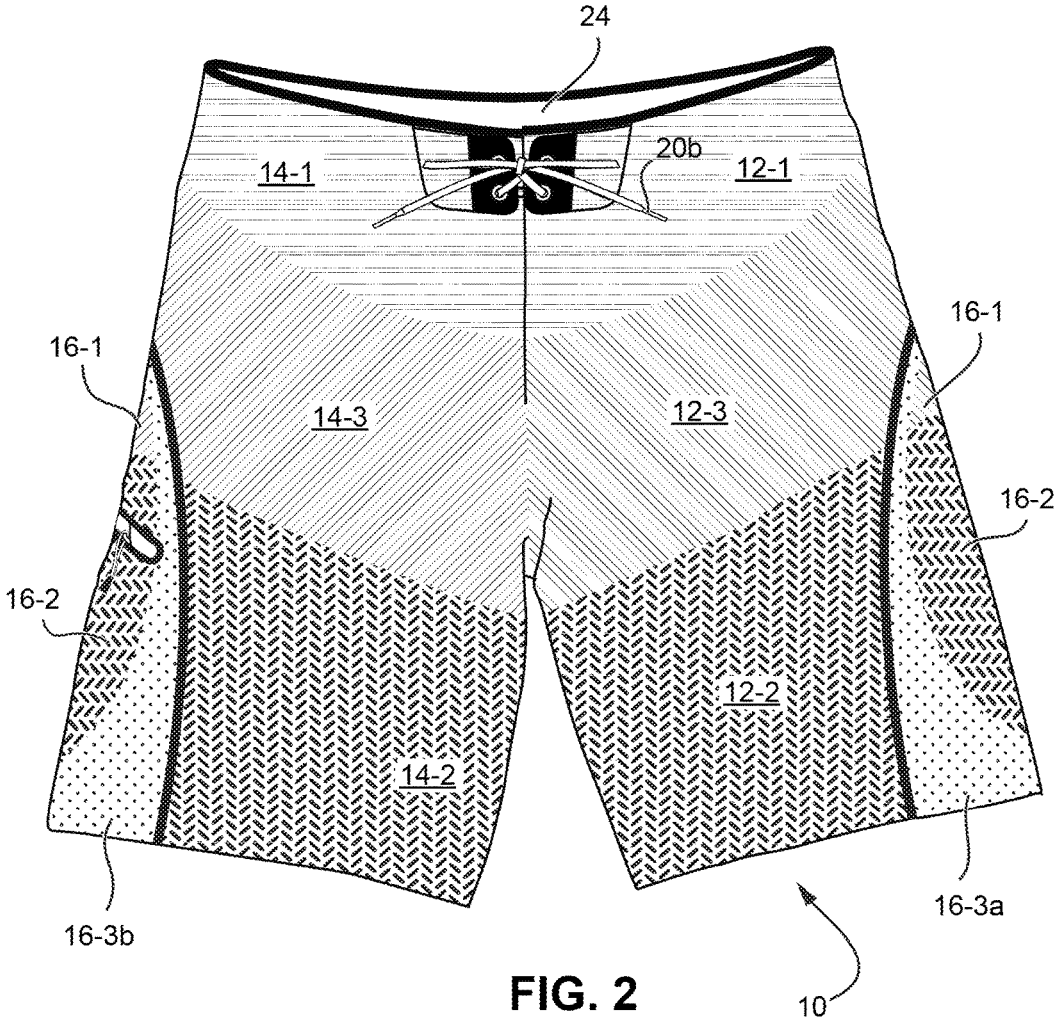
FIG. 2 is an isolated front elevational view of the water shorts depicted in FIG. 1.
Figure 3:
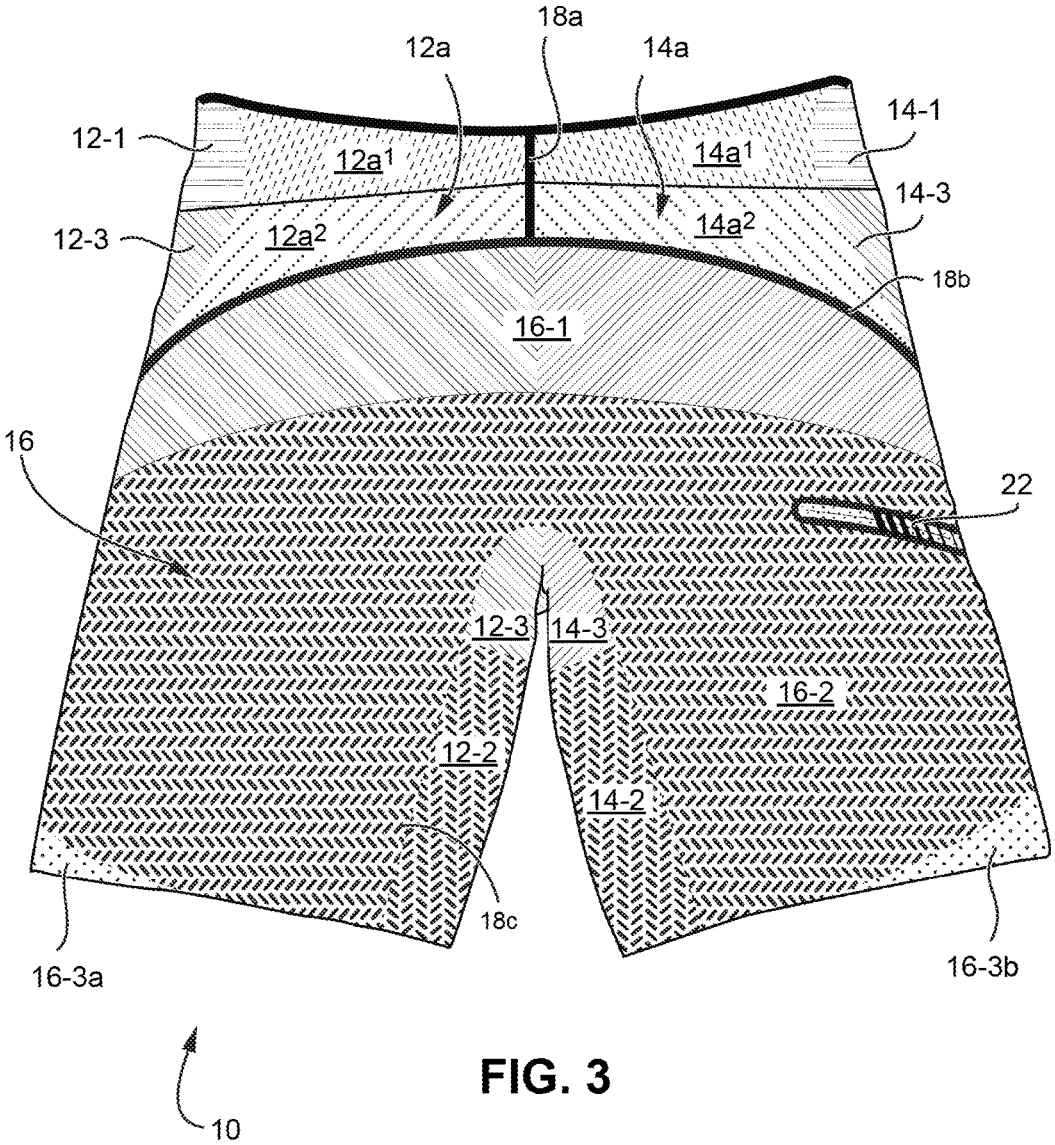
FIG. 3 is a rear elevational view of the water shorts depicted in FIG. 2.
Figure 4:
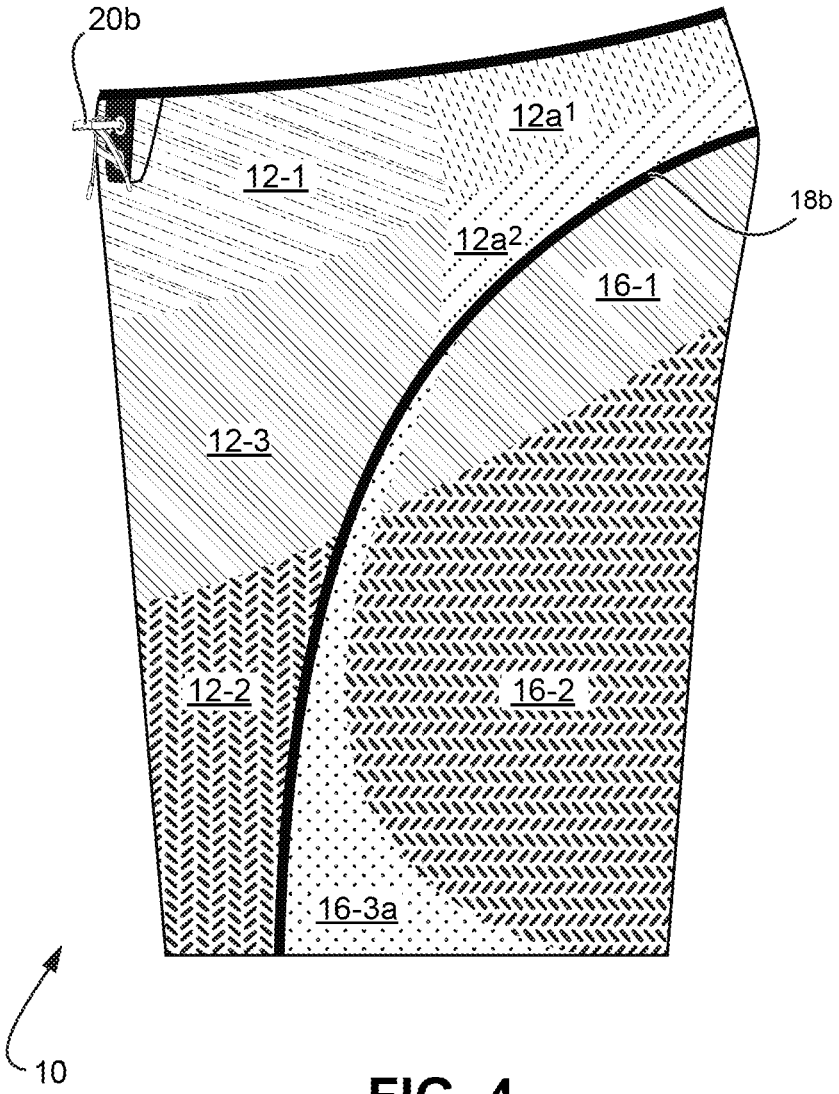
FIGS. 4 and 5 are left and right side elevational views of the water shorts depicted in FIG. 2.
Figure 5:
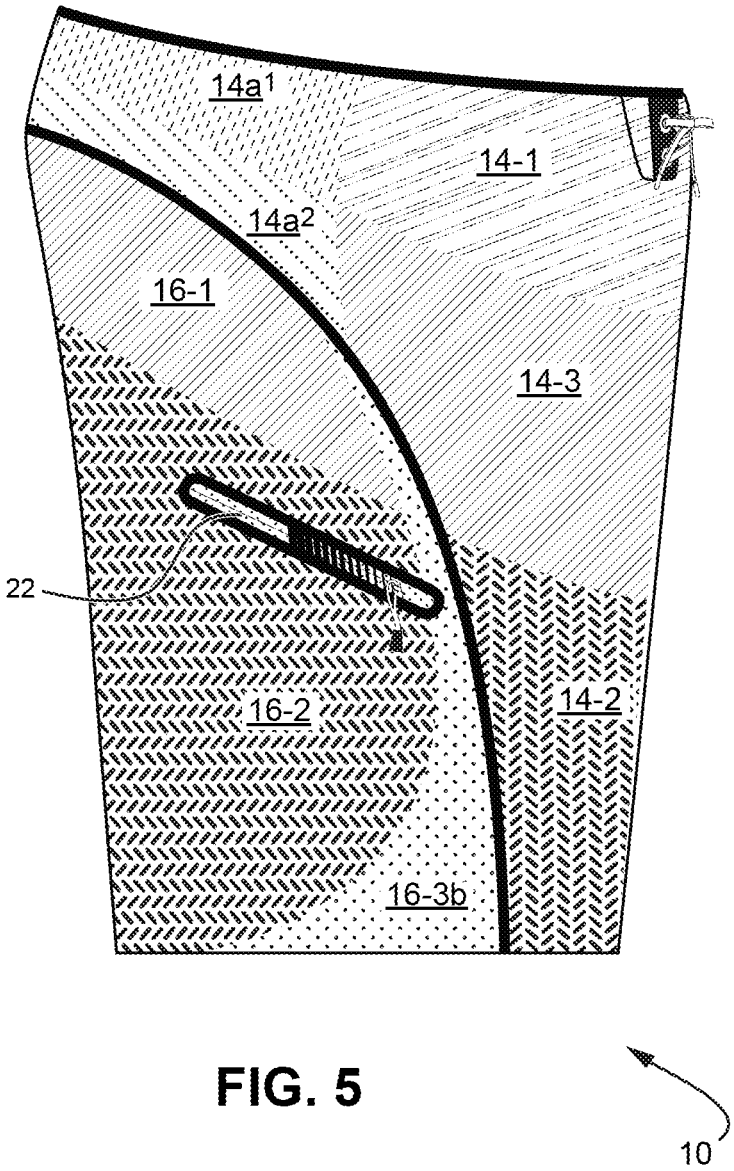
Figure 6:
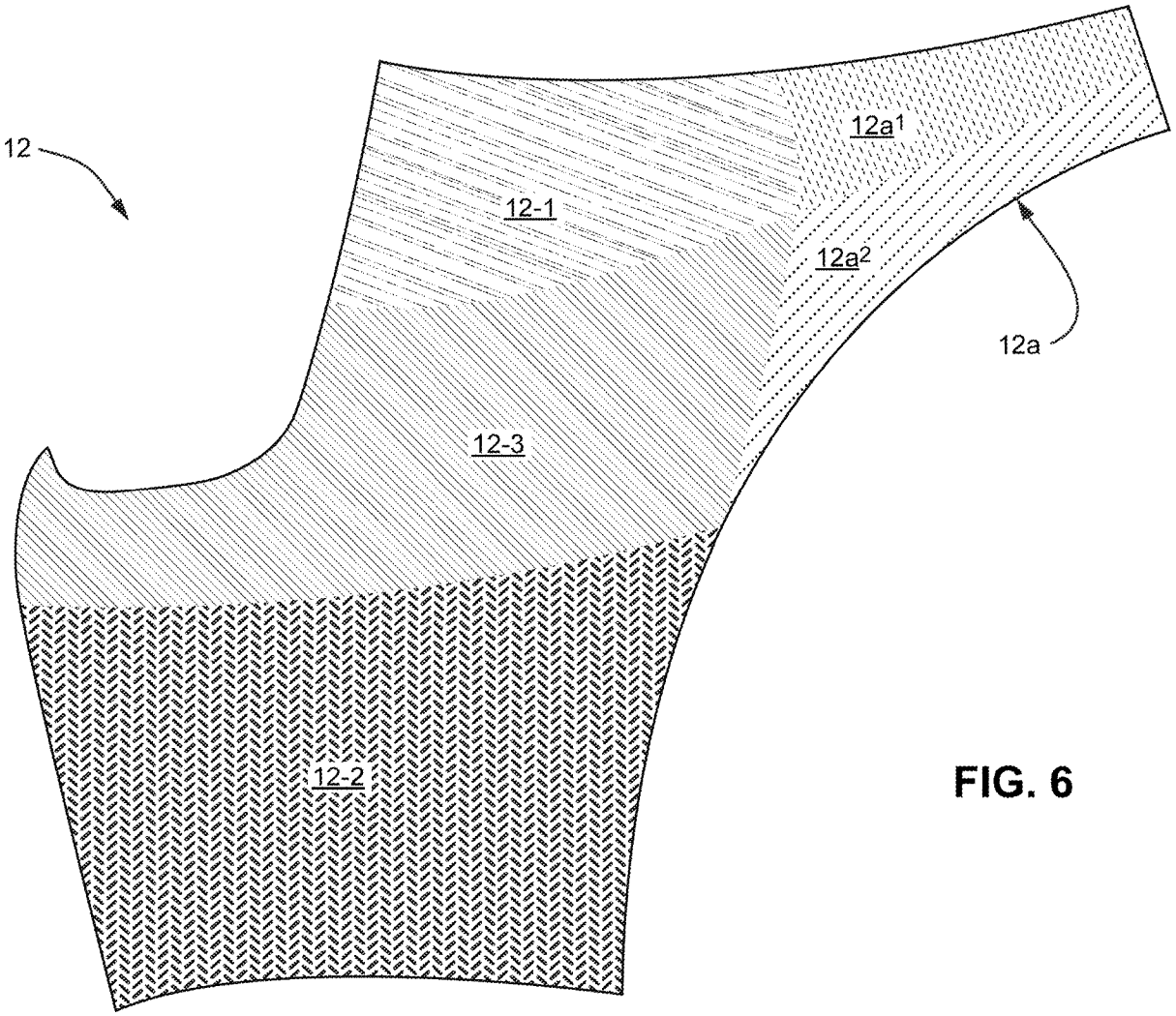
FIG. 6 is a plan view of the left side fabric panel employed in the water shorts of FIG. 2, the right side fabric panel being substantially a mirror image thereof.
Figure 7:
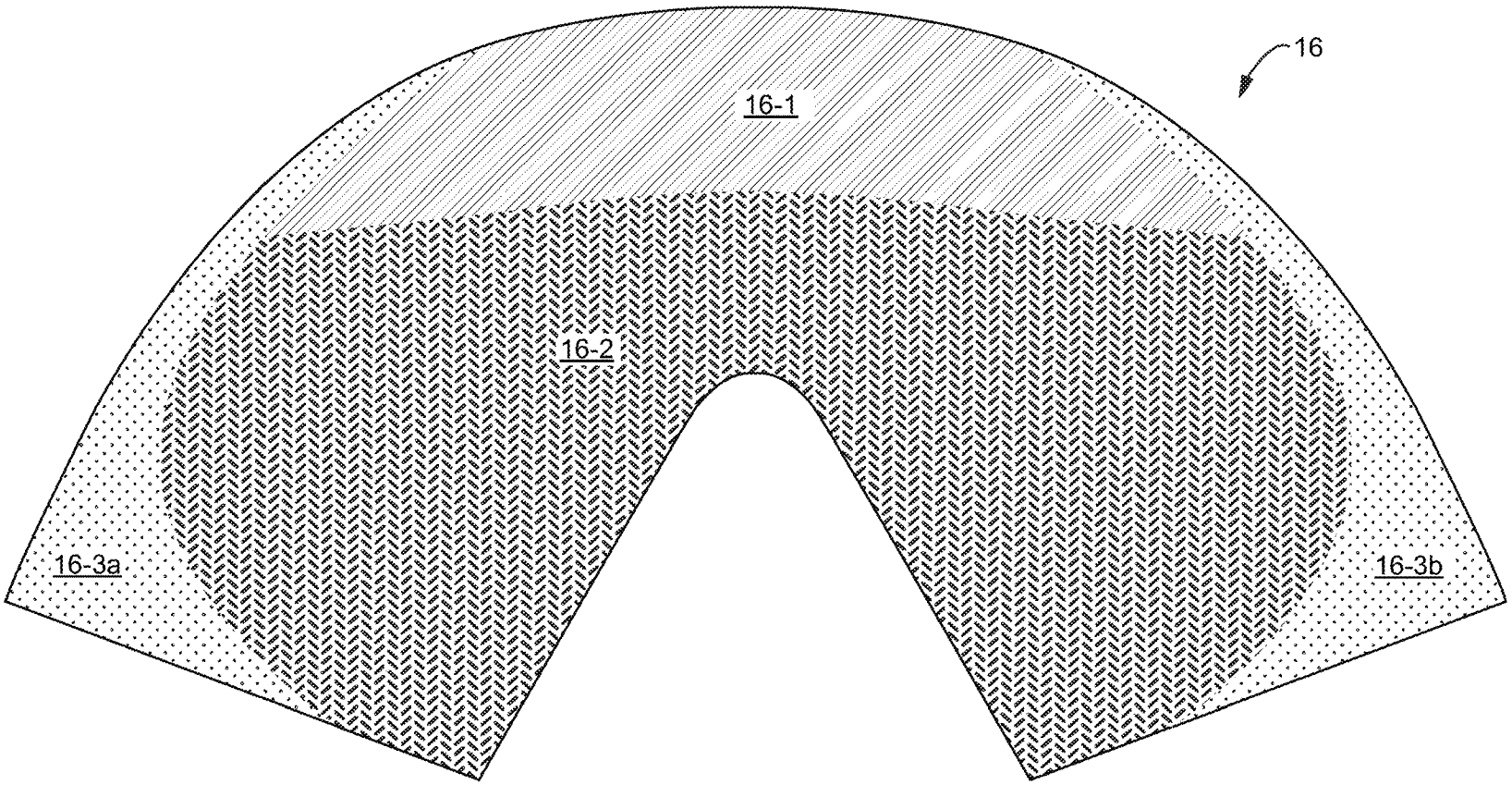
FIG. 7 is a plan view of the rear fabric panel employed in the water shorts of FIG. 2.

The water shorts 10 according to an embodiment of the invention are shown in FIG. 1 as being worn about the pelvic and upper thigh regions of a user. The water shorts 10 are comprised of multiple distinct one piece woven textile panels including left and right front panels 12, 14 having left and right rear waist sections 12*a*, 14*a*, and a rear panel 16. The panels may be welded to one another along seam lines 18*a*-18*c*, respectively. The water shorts may have a front fly 20*a* that is closed by means of any conventional fastening system (e.g., VELCRO® loop and pile fastener, zipper, buttons or the like) and laces 20*b* to close the waist band. The rear panel 16 may include a water-resistant zippered opening 22 to access a pocket formed by a fabric section (not shown) welded along its periphery to an interior region thereof. An elastomeric (rubberized) waistband 24 is thermally welded to the interior waist region of the shorts 10 to provide flexion as the user's hips and waist move. The waistband 24 also provides size stability through the waist and minimizes slippage from the user's waist region.

Important to the embodiments disclosed herein, each of the panels 12, 14 and 16 are unitary (one-piece) woven textile constructions having multiple differing fabric weave sections seamlessly adjacent one another. In the embodiment depicted in FIGS. 1-6, the left and right front panels 12, 14 will include an upper plain weave textile fabric section 12-1, 14-1, and a lower Dobby weave textile fabric section 12-2, 14-2 separated from one another by an intermediate twill weave textile fabric section 12-3, 14-3, respectively. Each of the fabric sections 12-1, 12-2 and 12-3 of the left front panel 12 and each of the fabric sections 14-1, 14-2 and 14-3 of the right front panel 14 form respective seamless interface boundaries therebetween due to the fabric panels 12 and 14 being a one-piece woven fabric construction.

The left and right rear waist sections 12*a*, 14*a* of the panels 12, 14 include an upper plain weave fabric section 12*a*1, 14*a*1 and a lower Dobby weave textile fabric section 12*a*2, 14*a*2, respectively. The opposed ends of the left and right rear waist sections 12*a*, 14*a* are thermally welded to one another along vertical rear waist seam 18*a*.

Like the left and right front panels 12, 14, the rear panel 16 is a unitary (one-piece) woven textile construction having multiple differing fabric weave sections seamlessly adjacent one another. The rear panel 16 is thermally welded to the panels 12, 14 along continuous seam 18*b*. As shown, the seam 18*b* has opposed ends located generally above the user's knee at the lower edge of the shorts 10 and extends upwardly and rearwardly around the user's buttock region with an apex being centrally located adjacent the user's rear waist. The rear panel 16 bounded by the seam 18*b* is constructed of multiple differing fabric weave sections seamlessly adjacent one another which thereby provide a seamless back rise in the shorts 10. In the depicted embodiment, the rear panel 16 includes an upper twill weave fabric section 16-1 and a lower Dobby weave fabric section 16-2. Lateral fabric sections 16-3*a* and 16-3*b* are formed of a Dobby weave textile fabric section that has a different (smaller) Dobby weave characteristic as compared to the (larger) Dobby weave of fabric section 16-2. The lateral arcuate woven fabric sections 16-3*a*, 16-3*b* are seamlessly joined to the upper twill weave section 16-1 and lower Dobby weave section 16-2 along respective arcuate interface boundaries therebetween.

Each of the fabric sections forming the panels 12, 14 and 16 of the shorts are engineered to impart optimal comfort to the user by providing differential stretch characteristics and stretch axes. By way of example, the plain weave fabric sections 12-1, 12*a*1, 14-1 and 14*a*-1 are designed to provide compact (minimal) 4-way stretch along the vertical and horizontal axes so as to hold shape and to support the user's waist and seat region. Each of the plain weave fabric sections 12-1, 12*a*1, 14-1 and 14*a*-1 may have the same or different maximum stretch characteristics. A specific plain weave fabric that may be employed for fabric sections 12-1, 12*a*1, 14-1 and 14*a*-1 is a plain fabric construction of about 140 gm/m$^2$ woven 164×156/50 denier polyester+elastomeric filament×50 denier polyester yarns+elastomeric filament.

The twill weave sections 12-3, 14-3 and 16-1 provide a durable and angular weave that is capable of stretching along the horizontal and vertical axes of the shorts 10. Preferably the twill weave sections 12-3, 14-3 and 16-1 exhibit greater maximum stretch along the horizontal and vertical axes of the shorts as compared to the respective plain weave fabric sections 12-1, 12*a*1, 14-1 and 14*a*-1 seamlessly adjacent thereto. A specific twill weave fabric that may be employed for fabric sections 12-1, 12*a*1, 14-1 and 14*a*-1 a twill fabric construction of about 146 gm/m$^2$ woven 164×156/50 denier polyester+elastomeric filament× 50 denier polyester yarns+elastomeric filament.

The Dobby weave sections 12*a*2, 12-2, 14*a*2, 14-2 and 16-2 are lower and loftier weave constructions possessing stretch characteristics along the vertical, horizontal and diagonal (45° bias) axes of the shorts 10. The relatively open weave of the Dobby weave sections 12*a*2, 12-2, 14*a*2, 14-2 and 16-2 create repetitive perforations that eliminate cling to the user's body with the fabric is wet, reduces weight and promotes breathability. Preferred embodiments of the Dobby weave sections **12*a*2, 12-2, 14*a*2, 14-2 and 16-2 will possess ordered rows of spaced-apart perforations with perforations in adjacent rows being off-set relative to one another. The nominal perforation size and inter-perforation spacing of the upper Dobby weave sections 12*a*2, 14*a*2 are preferably relatively smaller (e.g., at least about 10% smaller or least about 20% smaller) as compared to the perforation size and inter-perforation spacing of the lower Dobby weave sections 12-2, 14-2 and 16-2. A particular fabric for the upper (smaller) Dobby weave sections 12*a*2, 14*a*2 may be Dobby fabric construction of about 152 gm/m$^2$ woven 164×166/50 denier polyester+elastomeric filament×50 denier polyester yarns+elastomeric filament, while a particular fabric for the lower (larger) Dobby weave sections 12-2, 14-2 and 16-2** is a Dobby fabric construction of about 134 gm/m$^2$ woven 164×160/50 denier polyester+elastomeric filament×50 denier polyester yarns+elastomeric filament.

The various panels 12, 14 and 16 may be woven from virtually any natural or synthetic filament or yarn. Preferably synthetic yarns are employed and can be formed from any desirable fiber-forming polymer such as polyamides (e.g., nylon 6, nylon 6,6, nylon 6,12 and the like), polyesters, polyolefins (e.g., polypropylene, polyethylene) and the like, as well as mixtures and copolymers of the same.

Similarly, any desirable elastomeric filament may be employed in order to impart the desired stretch characteristics to the woven panels 12, 14 and 16. Preferred elastic filaments are spandex filaments formed of a long chain synthetic elastomer comprised of at least 85% by weight of a segmented polyurethane typically interspersed with relatively soft segments of polyethers, polyester, polycarbonates and the like. A particularly preferred spandex filament is commercially available under the trade name LYCRA® having deniers of about 40 to about 70, typically a denier of about 50. Combinations of elastomeric and non-elastomeric filaments and yarns may also be employed. For example, one or more elastomeric filament(s) may be co-spun, wrapped or covered with a non-elastic fiber or filament, e.g. polyester.

The woven panels 12, 14 and/or 16 exhibit both stretch and elastic recovery following stretching as measured according to ASTM D3107-2007(2011) (incorporated fully by reference herein) as shown by the data below:

| Stretch Properties of Woven Fabric Panels (ASTM D3107-2007(2011)) | | |
|---|---|---|
| | Lengthwise (Warp) | Widthwise (Weft) |
| Fabric stretch after 4 lbs. tensioning for 30 min. | | |
| (%) | 30.0 | 38.8 |
| Fabric growth after 4 lbs. tensioning for 30 min. | | |
| (%) | 4.0 | 7.2 |
| Fabric growth after stretching to: | 31.4 cm | 33.3 cm |
| After 30 sec. relaxation (%) | 2.4 | 4.0 |
| After 30 min. relaxation (%) | 1.2 | 2.8 |
| After 1 hour relaxation (%) | 1.2 | 2.4 |
| Fabric recovery after stretching to: | 31.4 cm | 33.3 cm |
| After 30 sec. relaxation (%) | 90.6 | 87.9 |

-continued

| Stretch Properties of Woven Fabric Panels (ASTM D3107-2007(2011)) | | |
|---|---|---|
| | Lengthwise (Warp) | Widthwise (Weft) |
| After 30 min. relaxation (%) | 95.3 | 91.5 |
| After 1 hour relaxation (%) | 95.3 | 92.7 |

The invention herein is not to be limited to the disclosed embodiments, but on the contrary, is intended to cover various modifications and equivalent arrangements included within the spirit and scope of the appended claims.

What is claimed is:

1. Aquatic activity shorts comprising:

left and right front woven fabric panels, and a rear woven fabric panel, wherein each of the left and right front fabric panels is formed of a one piece woven fabric having seamlessly adjacent generally horizontally oriented bands of different woven fabric sections comprised of an upper woven fabric band at a waistband region of the aquatic activity shorts, a lower woven fabric band at a lower leg seam region of the aquatic activity shorts and an intermediate fabric band joining the upper and lower woven fabric bands, and wherein (i) the upper woven fabric band is a plain weave fabric providing four-way stretch along vertical and horizontal axes of the aquatic activity shorts to provide shape retention to the aquatic activity shorts at the waistband thereof;

(ii) the intermediate woven fabric band is an angular twill weave fabric having a greater stretch along the vertical and horizontal axes of the aquatic activity shorts as compared to the upper woven fabric band; and (iii) the lower woven fabric band is a Dobby weave fabric that possesses stretch characteristics along vertical, horizontal and diagonal axes and defines repetitive ordered rows of off-set perforations.

2. The aquatic activity shorts of claim 1, wherein the rear fabric panel is a one piece rear fabric panel comprising multiple seamlessly adjacent woven fabric sections.

3. The aquatic activity shorts of claim 2, wherein the left and right front woven fabric panels are joined to the rear fabric panel along a seam that has opposed ends located generally above a knee region of a user at a lower edge of the shorts and extends upwardly and rearwardly around a buttocks region of the user with an apex centrally located adjacent a rear waist region of the user.

4. The aquatic activity shorts of claim 1, wherein the multiple seamlessly adjacent different woven fabric sections of the woven fabric panel comprises woven fabrics selected from the group consisting of plain fabric weaves, twill fabric weaves and Dobby fabric weaves.

5. The aquatic activity shorts of claim 1, wherein the rear woven fabric panel comprises an upper twill weave section and a lower Dobby weave section seamlessly joined to one another along a respective interface boundary therebetween.

6. The aquatic activity shorts of claim 5, wherein the rear woven fabric panel further comprises lateral arcuate woven fabric sections seamlessly joined to the upper twill and lower Dobby weave sections along respective arcuate interface boundaries therebetween.

7. The aquatic activity shorts of claim 6, wherein the lateral arcuate woven fabric sections are formed of a Dobby weave construction which has smaller perforations as compared to perforations of the lower Dobby weave fabric section of the rear fabric panel.

8. The aquatic activity shorts of claim 1, wherein the one piece rear fabric panel provides a seamless back rise.

* * * * *